US008839753B2

(12) United States Patent
Burrows et al.

(10) Patent No.: US 8,839,753 B2
(45) Date of Patent: Sep. 23, 2014

(54) CORONA IGNITER HAVING IMPROVED GAP CONTROL

(75) Inventors: John Antony Burrows, Northwich (GB); James D. Lykowski, Temperance, MI (US); John William Hoffman, New Albany, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 349 days.

(21) Appl. No.: 13/339,737

(22) Filed: Dec. 29, 2011

(65) Prior Publication Data

US 2012/0192824 A1 Aug. 2, 2012

Related U.S. Application Data

(60) Provisional application No. 61/427,960, filed on Dec. 29, 2010.

(51) Int. Cl.

| | |
|---|---|
| ***F02P 23/00*** | (2006.01) |
| ***H01T 13/34*** | (2006.01) |
| ***H01T 13/36*** | (2006.01) |
| ***H01T 19/00*** | (2006.01) |
| ***H01T 21/02*** | (2006.01) |
| ***H01T 13/50*** | (2006.01) |

(52) U.S. Cl.

CPC ..... *H01T 13/50* (2013.01); *H01T 21/02* (2013.01)

USPC ..... 123/143 B; 123/169 E; 123/606; 313/137; 313/145

(58) Field of Classification Search

CPC ..... F02P 9/007; H01T 13/34; H01T 13/36; H01T 19/00

USPC ..... 123/143 B, 169 E, 606; 313/137, 145

See application file for complete search history.

(56) References Cited

U.S. PATENT DOCUMENTS

| | | | |
|---|---|---|---|
| 2,902,747 | A | 9/1959 | Reiter |
| 2,933,631 | A | 4/1960 | Logan |
| 3,013,174 | A | 12/1961 | Logan |

(Continued)

FOREIGN PATENT DOCUMENTS

FR 2 859 831 A1 9/2012

OTHER PUBLICATIONS

International Application mailed (PCT/US2011/067736) Apr. 11, 2012.

*Primary Examiner* — Erick Solis

(74) *Attorney, Agent, or Firm* — Robert L. Stearns; Dickinson Wright, PLLC

(57) ABSTRACT

A corona igniter 20 includes an electrode gap 28 between the central electrode 22 and the insulator 32 and a shell gap 30 between the insulator 32 and the shell 36. An electrically conductive coating 40 is disposed on the insulator 32 along the gaps 28, 30 to prevent corona discharge 24 in the gaps 28, 30 and to concentrate the energy at a firing tip 58 of the central electrode 22. The electrically conductive coating 40 is disposed on an insulator inner surface 64 and is spaced radially from the electrode 22. The electrically conductive coating 40 is also disposed on the insulator outer surface 72 and is spaced radially from the shell 36. During operation of the igniter 20, the electrically conductive coating 40 provides a reduced voltage drop across the gaps 28, 30 and a reduced electric field spike at the gaps 28, 30.

20 Claims, 7 Drawing Sheets

(56) References Cited

U.S. PATENT DOCUMENTS

| | | | | |
|---|---|---|---|---|
| 4,392,082 | A | 7/1983 | Harada | |
| 4,406,968 | A | 9/1983 | Friese et al. | |
| 4,939,409 | A | 7/1990 | Friese et al. | |
| 6,883,507 | B2 | 4/2005 | Freen | |
| 6,923,042 | B2 | 8/2005 | Hiramatsu | |
| 7,741,761 | B2 | 6/2010 | Jaffrezic et al. | |
| 8,550,048 | B2 * | 10/2013 | Stifel et al. | 123/143 B |
| 2007/0188063 | A1 | 8/2007 | Lykowski | |
| 2009/0033194 | A1 | 2/2009 | Jaffrezic et al. | |
| 2009/0256461 | A1 | 10/2009 | Walker, Jr. | |
| 2010/0019643 | A1 | 1/2010 | Kaiser et al. | |
| 2010/0083942 | A1 | 4/2010 | Lykowski et al. | |
| 2010/0175653 | A1 | 7/2010 | Lykowski et al. | |
| 2010/0175655 | A1 | 7/2010 | Lykowski et al. | |
| 2010/0282197 | A1 | 11/2010 | Permuy et al. | |
| 2011/0146640 | A1 | 6/2011 | Achstaetter | |
| 2011/0253089 | A1 * | 10/2011 | Braeuchle et al. | 123/143 B |
| 2013/0199484 | A1 * | 8/2013 | Stifel et al. | 123/143 B |

* cited by examiner

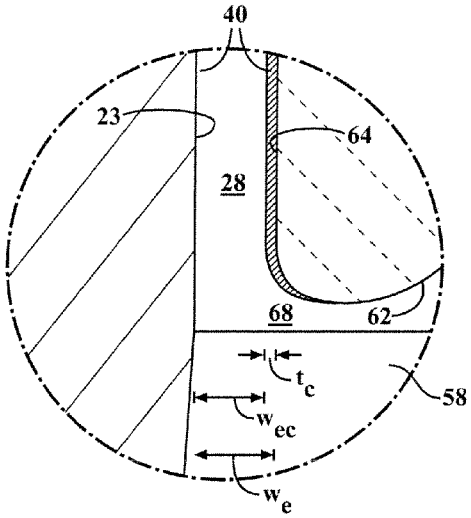
FIG. 2A
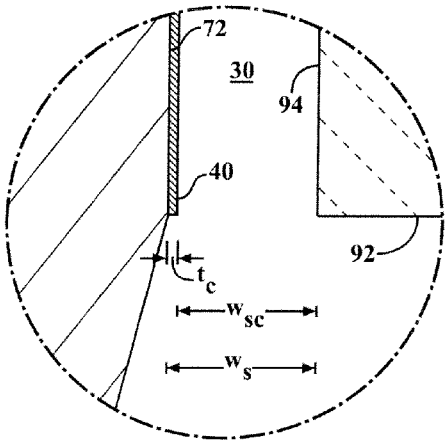
FIG. 2B
FIG. 3
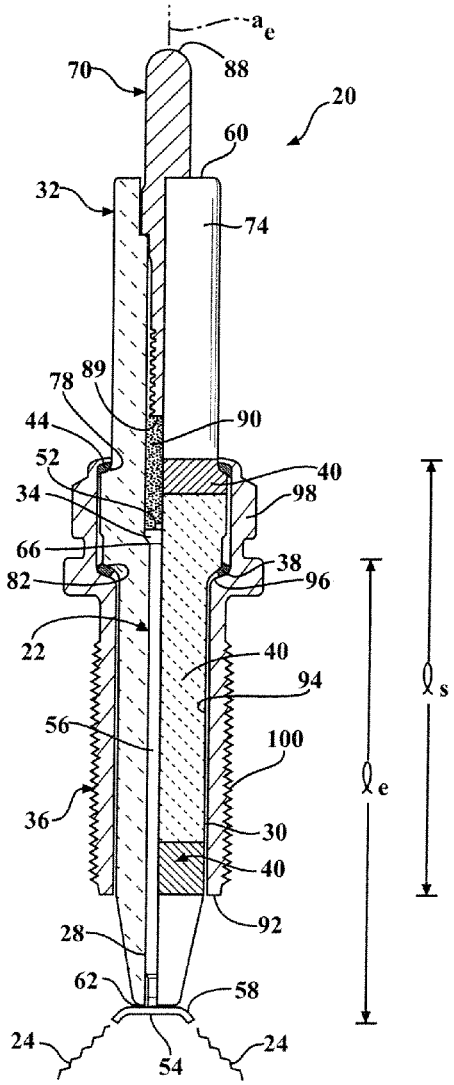

CORONA IGNITER HAVING IMPROVED GAP CONTROL

CROSS REFERENCE TO RELATED APPLICATION

This application claims the benefit of U.S. provisional application Ser. No. 61/427,960, filed Dec. 29, 2010.

BACKGROUND OF THE INVENTION

1. Field of the Invention

This invention relates generally to a corona igniter for emitting a radio frequency electric field to ionize a fuel-air mixture and provide a corona discharge, and a method of forming the corona igniter.

2. Related Art

Corona discharge ignition systems provide an alternating voltage and current, reversing high and low potential electrodes in rapid succession which makes arc formation difficult and enhances the formation of corona discharge. The system includes a corona igniter with a central electrode charged to a high radio frequency voltage potential and creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

The corona igniter typically includes the central electrode formed of an electrically conductive material for receiving the high radio frequency voltage and emitting the radio frequency electric field into the combustion chamber to ionize the fuel-air mixture and provide the corona discharge. An insulator formed of an electrically insulating material surrounds the central electrode and is received in a metal shell. The igniter of the corona discharge ignition system does not include any grounded electrode element intentionally placed in close proximity to a firing end of the central electrode. Rather, the ground is preferably provided by cylinder walls or a piston of the ignition system. An example of a corona igniter is disclosed in U.S. Patent Application Publication No. 2010/0083942 to Lykowski and Hampton.

The corona igniter may be assembled such that the clearance between the components results in small air gaps, for example an air gap between the central electrode and the insulator, and also between the insulator and the shell. These gaps are filled with air and gases from the surrounding manufacturing environment and during operation, gases from the combustion chamber. During use of the corona igniter, when energy is supplied to the central electrode, the electrical potential and the voltage drops significantly across the air gaps, as shown in FIGS. 6 and 7. The significant drop is due to the low relative permittivity of air.

The high voltage drop across the air gaps and the spike in electric field strength at the gaps tends to ionize the air in the gaps leading to significant energy loss at the firing end of the igniter. In addition, the ionized air in the gaps is prone to migrating toward the central electrode firing end, forming a conductive path across the insulator to the shell or the cylinder head, and reducing the effectiveness of the corona discharge at the central electrode firing end. The conductive path across the insulator may lead to arcing between those components, which is oftentimes undesired and reduces the quality of ignition at the central electrode firing end.

SUMMARY OF THE INVENTION

One aspect of the invention provides a corona igniter for providing a corona discharge. The corona igniter includes a central electrode formed of an electrically conductive material for receiving a high radio frequency voltage and emitting a radio frequency electric field to ionize a fuel-air mixture and provide a corona discharge. The central electrode extends from an electrode terminal end receiving the high radio frequency voltage to an electrode firing end emitting the radio frequency electric field. The central electrode extends along an electrode center axis and has an electrode surface facing away from the electrode center axis. An insulator formed of an electrically insulating material is disposed around the central electrode and extends longitudinally from an insulator upper end past the electrode terminal end to an insulator nose end. The insulator presents an insulator inner surface facing the electrode surface and an oppositely facing insulator outer surface extending between the insulator ends. The insulator inner surface is spaced from at least a portion of the electrode surface to present an electrode gap therebetween. A shell formed of an electrically conductive metal material is disposed around the insulator and extends longitudinally from a shell upper end to a shell lower end. The shell presents a shell inner surface facing the insulator outer surface and extending between the shell ends. The shell inner surface is spaced from at least a portion of the insulator outer surface to present a shell gap therebetween. An electrically conductive coating is disposed along at least one of the gaps on the insulator surface. The electrically conductive coating on the insulator surface is spaced radially from the facing surface another across the gap.

Another aspect of the invention provides a corona ignition system including the corona igniter.

Yet another aspect of the invention provides methods of forming the corona igniter. A first method includes the steps of providing a central electrode formed of an electrically conductive material and presenting an electrode surface. Next, the method includes providing an insulator formed of an electrically insulating material and including an insulator inner surface presenting an insulator bore extending longitudinally from an insulator upper end to an insulator nose end, and applying an electrically conductive coating to the insulator inner surface. The method then includes inserting the central electrode into the insulator bore after applying the electrically conductive coating such that the electrode surface faces and is spaced radially from at least a portion of the electrically conductive coating on the insulator inner surface across an electrode gap.

Another method includes applying an electrically conductive coating to an insulator outer surface, providing a shell formed of an electrically conductive material and including a shell inner surface presenting a shell bore extending longitudinally from a shell upper end to a shell lower end. Next, the method includes inserting the insulator into the shell bore after applying the electrically conductive coating such that the electrically conductive coating on the insulator outer surface faces and is spaced radially from at least a portion of the shell inner surface across a shell gap.

The electrically conductive coatings of the igniter provide electrical continuity across the air gaps. They prevent an electric charge from being contained in the gaps, prevent electricity from flowing through the gaps, and prevent the formation of ionized gas and corona discharge in the gaps, which could form a conductive path and arcing across the insulator between the electrode and the shell or between the electrode and the cylinder head. Thus, the corona igniter is able to provide a more concentrated corona discharge at the firing tip and a more robust ignition, compared to other corona igniters.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2A is an enlarged view of the electrode gap of FIG. 5;

FIG. 2B is an enlarged view of the shell gap of FIG. 5;

FIG. 3 is a cross-sectional view of a corona igniter disposed in a combustion chamber according to another embodiment of the invention;

DETAILED DESCRIPTION OF THE ENABLING EMBODIMENTS

Figure 1:
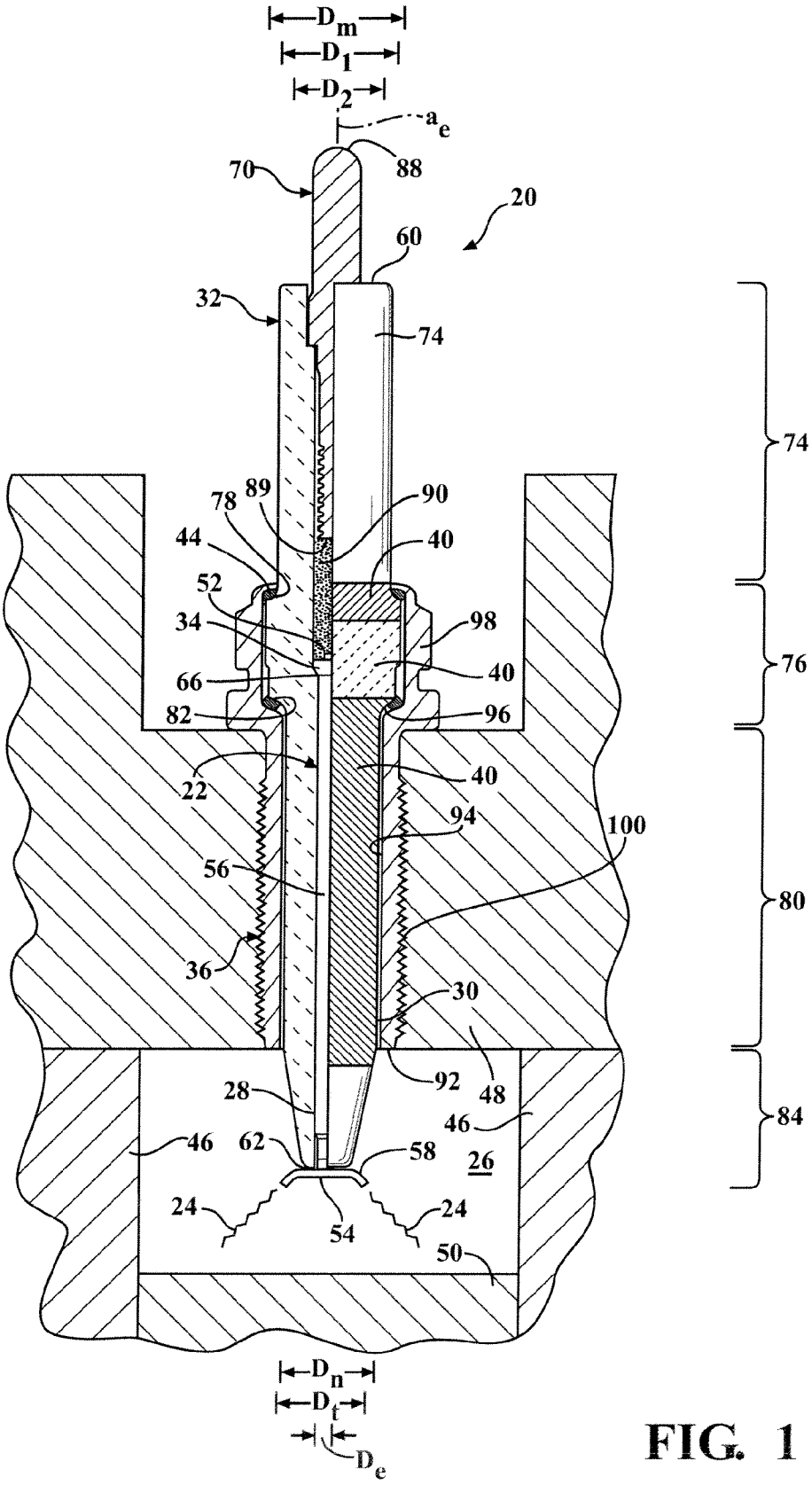
FIG. 1 is a cross-sectional view of a corona igniter disposed in a combustion chamber according to one embodiment of the invention.

One aspect of the invention provides a corona igniter 20 for a corona discharge ignition system. The system intentionally creates an electrical source which suppresses the formation of an arc and promotes the creation of strong electrical fields which produce corona discharge 24. The ignition event of the corona discharge ignition system includes multiple electrical discharges running at approximately 1 megahertz.

The igniter 20 of the system includes a central electrode 22 for receiving energy at a high radio frequency voltage and emitting a radio frequency electric field to ionize a portion of a combustible fuel-air mixture and provide a corona discharge 24 in a combustion chamber 26 of an internal combustion engine. The method used to efficiently assemble the corona igniter 20 requires clearance between the central electrode 22, insulator 32, and shell 36 resulting in small air gaps 28, 30 between those components.

The central electrode 22 is inserted into the insulator 32 such that a head 34 of the central electrode 22 rests on an electrode seat 66 along a bore of the insulator 32 and the other sections of the central electrode 22 are spaced from the insulator 32. An electrode gap 28 is provided between the electrode 22 and the insulator 32, allowing air to flow between the electrode 22 and insulator 32. In one preferred embodiment, the insulator 32 is inserted into the metal shell 36 with an internal seal 38 spacing the insulator 32 from the shell 36. A shell gap 30 extends continuously between the insulator 32 and shell 36, allowing air to flow between the insulator 32 and shell 36. To prevent corona discharge 24 from forming in the air gaps 28, 30, conductive coatings 40 are disposed on the insulator 32 before assembling the components together.

The corona igniter 20 is typically used in an internal combustion engine of an automotive vehicle or industrial machine. As shown in FIG. 1, the engine typically includes a cylinder block 46 having a side wall extending circumferentially around a cylinder center axis and presenting a space therebetween. The side wall of the cylinder block 46 has a top end surrounding a top opening, and a cylinder head 48 is disposed on the top end and extends across the top opening. A piston 50 is disposed in the space along the side wall of the cylinder block 46 for sliding along the side wall during operation of the internal combustion engine. The piston 50 is spaced from the cylinder head 48 such that the cylinder block 46 and the cylinder head 48 and the piston 50 provide the combustion chamber 26 therebetween. The combustion chamber 26 contains the combustible fuel-air mixture ionized by the corona igniter 20. The cylinder head 48 includes an access port receiving the igniter 20, and the igniter 20 extends transversely into the combustion chamber 26. The igniter 20 receives a high radio frequency voltage from a power source (not shown) and emits the radio frequency electric field to ionize a portion of the fuel-air mixture and form the corona discharge 24.

The central electrode 22 of the igniter 20 extends longitudinally along an electrode center axis $a_e$ from an electrode terminal end 52 to an electrode firing end 54. Energy at the high radio frequency AC voltage is applied to the central electrode 22 and the electrode terminal end 52 receives the energy at the high radio frequency AC voltage, typically a voltage up to 40,000 volts, a current below 1 ampere, and a frequency of 0.5 to 5.0 megahertz. The highest voltage applied to the central electrode 22 is referred to as a maximum voltage. The electrode 22 includes an electrode body portion 56 formed of an electrically conductive material, such as nickel. In one embodiment, the electrode body portion 56 can include a core formed of another electrically conductive material, such as copper. In one embodiment, the materials of the electrode 22 have a low electrical resistivity of below 1,200 nΩ·m. The electrode body portion 56 has an electrode surface 23 facing away from said electrode center axis $a_e$. The electrode body portion 56 also presents an electrode diameter $D_e$ being perpendicular to the electrode center axis $a_e$. The electrode body portion 56 includes the electrode head 34 at the electrode terminal end 52. The head 34 has an electrode diameter $D_e$ greater than the electrode diameter $D_e$ along the remaining sections of the electrode body portion 56.

According to one preferred embodiment, the central electrode 22 includes a firing tip 58 surrounding and adjacent the electrode firing end 54 for emitting the radio frequency electric field to ionize a portion of the fuel-air mixture and provide the corona discharge 24 in the combustion chamber 26. The firing tip 58 is formed of an electrically conductive material providing exceptional thermal performance at high temperatures, for example a material including at least one element selected from Groups 4-12 of the Periodic Table of the Elements. As shown in FIG. 1, the firing tip 58 presents a tip diameter $D_t$ that is greater than the electrode diameter $D_e$ of the electrode body portion 56.

Figure 2:
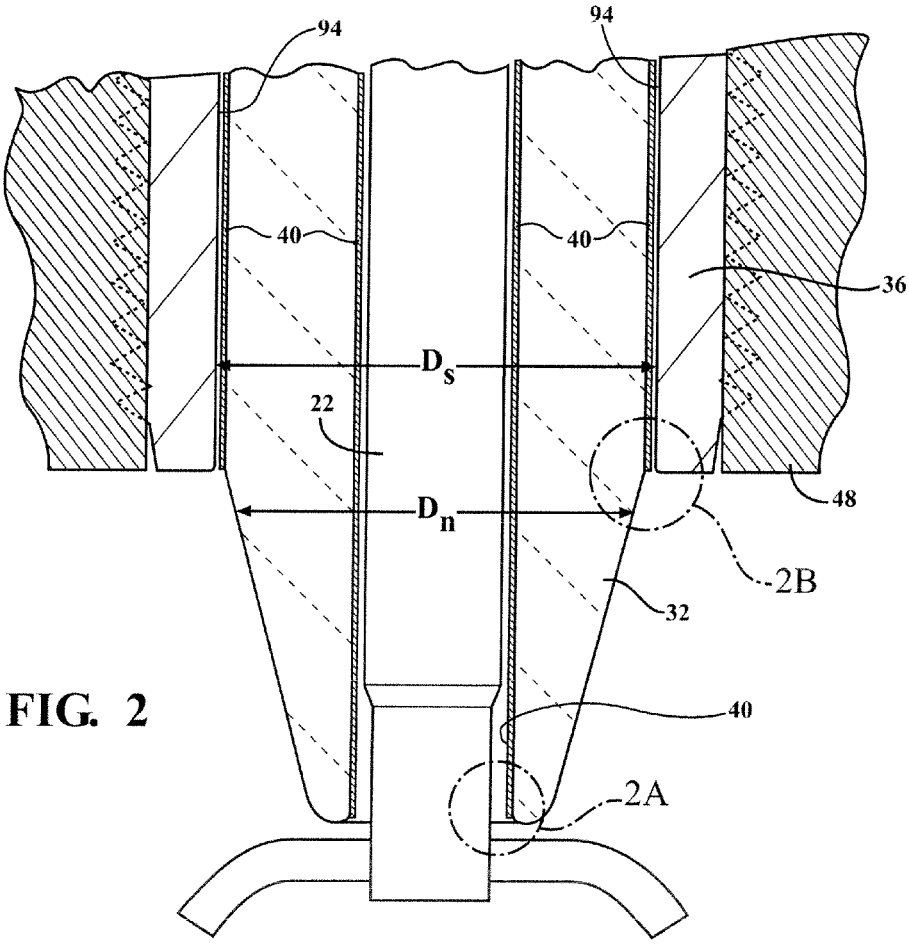
FIG. 2 is an enlarged view of an insulator nose region according to one embodiment of the invention.

The insulator 32 of the corona igniter 20 is disposed annularly around and longitudinally along the electrode body portion 56. The insulator 32 extends longitudinally from an insulator upper end 60 past the electrode terminal end 52 an insulator nose end 62. FIG. 2 is an enlarged view of the insulator nose end 62 according to one embodiment of the invention, wherein the insulator nose end 62 is spaced from the electrode firing end 54 and the firing tip 58 of the electrode 22. According to another embodiment (not shown), the firing tip 58 abuts the insulator 32 so that there is no space therebetween.

The insulator 32 is formed of an electrically insulating material, typically a ceramic material including alumina. The insulator 32 has an electrical conductivity less than the electrical conductivity of the central electrode 22 and the shell 36. In one embodiment, the insulator 32 has a dielectric strength of 14 to 25 kV/mm. The insulator 32 also has a relative permittivity capable of holding an electrical charge, typically a relative permittivity of 6 to 12. In one embodiment, the insulator 32 has a coefficient of thermal expansion (CTE) between $2\times10^{-6}$/° C. and $10\times10^{-6}$/° C.

The insulator 32 includes an insulator inner surface 64 facing the electrode surface 23 of the electrode body portion 56 and extending longitudinally along the electrode center axis $a_e$ from the insulator upper end 60 to the insulator nose end 62. The insulator inner surface 64 presents an insulator bore receiving the central electrode 22 and includes the electrode seat 66 for supporting the head 34 of the central electrode 22.

The electrode firing end 54 is inserted through the insulator upper end 60 and into the insulator bore until the head 34 of the central electrode 22 rests on the electrode seat 66 along the bore of the insulator 32. The remaining portions of the electrode body portion 56 below the head 34 are spaced from the insulator inner surface 64 to provide the electrode gap 28 therebetween. The corona igniter 20 is also assembled so that the electrode firing end 54 and the firing tip 58 are disposed outwardly of the insulator nose end 62. In one embodiment, shown in FIG. 2, the insulator nose end 62 and the firing tip 58 present a tip space 68 therebetween allowing ambient air to flow between the insulator nose end 62 and the firing tip 58.

The electrode gap 28 between the insulator inner surface 64 and the electrode body portion 56 extends continuously along the electrode surface 23 of the electrode body portion 56 from the electrode firing end 54 to the enlarged head 34, and also annularly around the electrode body portion 56. In one embodiment, the electrode body portion 56 has a length $l_e$, as shown in FIG. 3, and the electrode gap 28 extends longitudinally along at least 80% of the length $l_e$. The electrode gap 28 also has an electrode gap width $w_e$ extending perpendicular to the electrode center axis $a_e$ and radially from the electrode body portion 56 to the insulator inner surface, as shown in FIG. 2A. In one embodiment, the electrode gap width $w_e$ is 0.025 mm to 0.25 mm.

In one embodiment, the electrode gap 28 is open at the insulator nose end 62 and in fluid communication with the tip space 68. Thus, air from the surrounding environment can flow along the firing tip 58 through the tip space 68 and into the electrode gap 28 up to the head 34 of the electrode 22.

The insulator 32 of the corona igniter 20 includes an insulator outer surface 72 opposite the insulator inner surface 64 and extending longitudinally along the electrode center axis $a_e$ from the insulator upper end 60 to the insulator nose end 62. The insulator outer surface 72 faces opposite the insulator inner surface 64, outwardly toward the shell 36, and away from the central electrode 22. In one preferred embodiment, the insulator 32 is designed to fit securely in the shell 36 and allow for an efficient manufacturing process.

As shown in FIG. 1, the insulator 32 includes an insulator first region 74 extending along the electrode body portion 56 from the insulator upper end 60 toward the insulator nose end 62. The insulator first region 74 presents an insulator first diameter $D_1$ extending generally perpendicular to the electrode center axis $a_e$. The insulator 32 also includes an insulator middle region 76 adjacent the insulator first region 74 extending toward the insulator nose end 62. The insulator middle region 76 also presents an insulator middle diameter $D_m$ extending generally perpendicular to the electrode center axis $a_e$, and the insulator middle diameter $D_m$ is greater than the insulator first diameter D. An insulator upper shoulder 78 extends radially outwardly from the insulator first region 74 to the insulator middle region 76.

The insulator 32 also includes an insulator second region 80 adjacent the insulator middle region 76 extending toward the insulator nose end 62. The insulator second region 80 presents an insulator second diameter $D_2$ extending generally perpendicular to the electrode center axis $a_e$, which is less than the insulator middle diameter $D_m$. An insulator lower shoulder 82 extends radially inwardly from the insulator middle region 76 to the insulator second region 80.

The insulator 32 further includes an insulator nose region 84 extending from the insulator second region 80 to the insulator nose end 62. The insulator nose region 84 presents an insulator nose diameter $D_n$ extending generally perpendicular to the electrode center axis $a_e$ and tapering to the insulator nose end 62. In the embodiment of FIG. 3, the insulator 32 includes an insulator nose shoulder 86 extending radially inwardly from the insulator second region 80 to the insulator nose region 84. The insulator nose diameter $D_n$ at the insulator nose end 62 is less than the insulator second diameter $D_2$ and less than the tip diameter $D_t$ of the firing tip 58.

As shown in FIGS. 1 and 3, the corona igniter 20 includes a terminal 70 formed of an electrically conductive material received in the insulator 32. The terminal 70 includes a first terminal end 88 electrically connected to a terminal wire (not shown), which is electrically connected to the power source (not shown). The terminal 70 also includes an electrode terminal end 89, which is in electrical communication with the electrode 22. Thus, the terminal 70 receives the high radio frequency voltage from the power source and transmits the high radio frequency voltage to the electrode 22. A conductive seal layer 90 formed of an electrically conductive material is disposed between and electrically connects the terminal 70 and the electrode 22 so that the energy can be transmitted from the terminal 70 to the electrode 22.

The shell 36 of the corona igniter 20 is disposed annularly around the insulator 32. The shell 36 is formed of an electrically conductive metal material, such as steel. In one embodiment, the shell 36 has a low electrical resistivity below 1,000 nΩ·m. As shown in FIGS. 1 and 3, the shell 36 extends longitudinally along the insulator 32 from a shell upper end 44 to a shell lower end 92. The shell 36 includes a shell inner surface 94 facing the insulator outer surface 72 and extending longitudinally from the insulator first region 74 along the insulator upper shoulder 78 and the insulator middle region 76 and the insulator lower shoulder 82 and the insulator second region 80 to the shell lower end 92 adjacent the insulator nose region 84. The shell inner surface 94 presents a shell bore receiving the insulator 32. The shell inner surface 94 also presents a shell diameter $D_s$ extending across the shell bore. The shell diameter $D_s$ is greater than the insulator nose diameter $D_n$ such that the insulator 32 can be inserted in the shell bore and at least a portion of the insulator nose region 84 projects outwardly of the shell lower end 92.

The shell inner surface 94 presents at least one shell seat 96 for supporting the insulator lower shoulder 82 or the insulator nose shoulder 86, or both. In the embodiment of FIG. 1, the shell 36 includes one shell seat 96 disposed adjacent a tool receiving member 98 and supporting the insulator lower shoulder 82. In the embodiment of FIG. 3, the shell 36 includes two shell seats 96, one disposed adjacent the tool receiving member 98 and another disposed adjacent the shell lower end 92 for supporting the insulator nose shoulder 86.

In one embodiment, the corona igniter 20 includes at least one of the internal seals 38 disposed between the shell inner surface 94 and the insulator outer surface 72 to support the insulator 32 once the insulator 32 is inserted into the shell 36. The internal seals 38 space the insulator outer surface 72 from the shell inner surface 94 to provide the shell gap 30 therebetween. When the internal seals 38 are employed, the shell gap 30 typically extends continuously from the shell upper end 44 to the shell lower end 92. As shown in FIG. 1, one of the internal seals 38 is typically disposed between the insulator outer surface 72 of the insulator lower shoulder 82 and the shell inner surface 94 of the shell seat 96 adjacent the tool receiving member 98. In the embodiment of FIG. 3, one of the internal seals 38 is also disposed between the insulator outer surface 72 of the insulator nose shoulder 86 and the shell inner surface 94 of the shell seat 96 adjacent the insulator nose region 84. The embodiments of FIGS. 1 and 3 also include one of the internal seals 38 between the insulator outer surface 72 of the insulator upper shoulder 78 and the shell inner surface 94 of the turnover lip 42 of the shell 36. The internal seals 38 are positioned to provide support and maintain the insulator 32 in position relative to the shell 36.

The insulator 32 rests on the internal seals 38 disposed on the shell seats 96. In the embodiments of FIGS. 1 and 3, the remaining sections of the insulator 32 are spaced from the shell inner surface 94, such that the insulator outer surface 72 and the shell inner surface 94 present the shell gap 30 therebetween. The shell gap 30 extends continuously along the insulator outer surface 72 from the insulator upper shoulder 78 to the insulator nose region 84, and also annularly around the insulator 32. As shown in FIG. 3, the shell 36 has a length $l_s$, and the shell gap 30 typically extends longitudinally along at least 80% of the length $l_s$. When the internal seals 38 are used, the shell gap 30 can extend along 100% of the length $l_s$ of the shell 36. The shell gap 30 also has a shell gap width $w_s$ extending perpendicular to the electrode center axis $a_e$ and radially from the insulator outer surface 72 to the shell inner surface 94. In one embodiment, the shell gap width $w_s$ is 0.075 mm to 0.300 mm. The shell gap 30 is open at the shell lower end 92 such that air from the surrounding environment can flow into the shell gap 30 and along the insulator outer surface 72 up to the internal seals 38.

In an alternate embodiment, the insulator outer surface 72 rests on the shell seat 96 without the internal seals 38. In this embodiment, the shell gap 30 may only be located at the shell upper end 44 or along certain portions of the insulator outer surface 72, but not continuously between the shell upper end 44 and the shell lower end 92.

The shell 36 also includes a shell outer surface 100 opposite the shell inner surface 94 extending longitudinally along the electrode center axis $a_e$ from the shell upper end 44 to the shell lower end 92 and facing outwardly away from the insulator 32. The shell 36 includes the tool receiving member 98, which can be employed by a manufacturer or end user to install and remove the corona igniter 20 from the cylinder head 48. The tool receiving member 98 extends along the insulator middle region 76 from the insulator upper shoulder 78 to the insulator lower shoulder 82. The tool receiving member 98 presents a tool thickness extending generally perpendicular to the longitudinal electrode body portion 56. In one embodiment, the shell 36 also includes threads along the insulator second region 80 for engaging the cylinder head 48 and maintaining the corona igniter 20 in a desired position relative to the cylinder head 48 and the combustion chamber 26.

The shell 36 includes a turnover lip 42 extending longitudinally from the tool receiving member 98 along the insulator outer surface 72 of the insulator middle region 76, and then and inwardly along the insulator upper shoulder 78 to the shell upper end 44 adjacent the insulator first region 74. The turnover lip 42 extends annularly around the insulator upper shoulder 78 so that the insulator first region 74 projects outwardly of the turnover lip 42. A portion of the shell inner surface 94 along the turnover lip 42 engages the insulator middle region 76 and helps fix the shell 36 against axial movement relative to the insulator 32. However, the remaining portions of the shell inner surface 94 are typically spaced from the insulator outer surface 72.

Figure 1A:
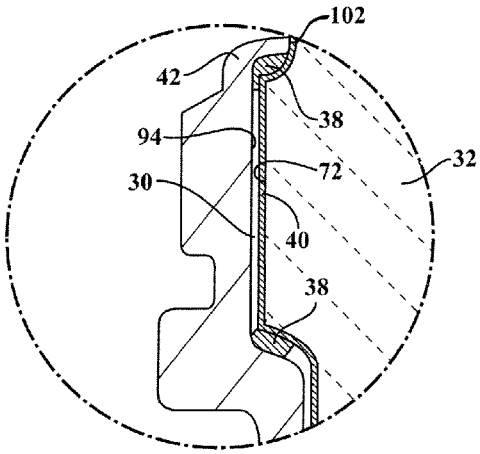
FIG. 1A is an enlarged cross-section view of a turnover region the corona igniter of FIG. 1.

The shell gap 30 is typically located between the shell 36 and insulator 32 in the turnover region and also at the shell lower end 92 up to the internal seals 38. As best shown in FIG. 1A and, the turnover lip 42 of the shell 36 includes a lip surface 102 between the shell inner surface 94 and the shell outer surface 100 facing the insulator outer surface 72 of the insulator first region 74. The turnover lip 42 has a lip thickness extending from the shell inner surface 94 to the shell outer surface 100, which is typically less than the tool thicknesses. In one embodiment, the entire lip surface 102 engages the insulator outer surface 72 and the shell gap 30 is located between the shell outer surface 100 along the turnover lip 42 and the insulator 32. In another embodiment, the lip surface 102 is completely spaced from the shell outer surface 100 and the shell gap 30 is provided between the lip surface 102 and the insulator 32. In yet another embodiment, a portion of the lip surface 102 engages the insulator outer surface 72 and the shell gap 30 is provided between a portion of the lip surface 102 and the insulator 32. The shell gap 30 is open at the shell upper end 44 in the turnover region such that air from the surrounding environment can flow therein.

The electrically conductive coatings 40 are disposed along least one of the gaps 28, 30 of the igniter 20, and preferably along both the electrode gap 28 and the shell gap 30. As shown in FIG. 2A, a first electrically conductive coating 40 is disposed on the insulator inner surface 64 and is spaced radially from the electrode surface 23 across the electrode gap 28 to present an electrode coating space width $w_{ec}$ therebetween. In one embodiment, the electrode coating space width $w_{ec}$ is 50 to 250 microns.

As shown in FIG. 2B, a second electrically conductive coating 40 is disposed on the insulator outer surface 72 and is spaced radially from the shell inner surface 94 across the shell gap 30 to present a shell coating space width $w_{sc}$ therebetween. In one embodiment, the shell coating space width $w_{sc}$ is 50 to 250 microns. The electrically conductive coating 40 electrically connects both sides of the electrode gaps 28 together and both sides of the shell gap 30 together, thereby reducing the strength of the electric field in the gaps 28, 30 and the voltage drop across the gaps 28, 30 and preventing corona discharge 24 from forming in the gaps 28, 30.

The electrically conductive coatings 40 are formed of an electrically conductive material and have an electrical conductivity of $9\times10^6$ S/m to $65\times10^6$ S/m, or above $9\times10^6$ S/m, and preferably above $30\times10^6$ S/m. The electrically conductive coatings 40 are distinct and separate from the central electrode 22, insulator 32, and shell 36. The electrically conductive coatings 40 on the insulator surfaces 64, 72 can include the same or difference conductive materials. Further, the igniter 20 can include the same electrically conductive material along the entire length of the igniter 20, or different materials in different areas of the igniter 20. In an alternate embodiment, the electrically conductive coatings 40 is also disposed on the electrode surface 23 or the shell inner surface 94, but this is not required since those surfaces 23, 94 are formed of an electrically conductive material.

In one embodiment, the electrically conductive coatings 40 include at least one element selected from Groups 4-11 of the Periodic Table of the Elements, for example, silver, gold, platinum, iridium, palladium, and alloys thereof. In another embodiment, the electrically conductive coatings 40 include a non-precious metal, for example aluminum or copper. In yet another embodiment, the electrically conductive coatings 40 include a mixture of the metal and glass powder, such as a frit. The glass powder typically includes silica, and in one embodiment, the electrically conductive coating 40 includes silica in an amount of at least 30 wt. %, based on the total weight of the electrically conductive coating 40. The electrically conductive coating 40 can include a mixture of the precious metal and the glass powder, or the non-precious metal and the glass powder.

When the electrically conductive coating 40 is disposed along the electrode gap 28, a first electrically conductive coating 40 is disposed on the insulator inner surface 64 between the insulator upper end 60 and the insulator nose end 62. As shown in FIG. 2A, the first electrically conductive coating 40 is radially spaced from the electrode surface 23 across the electrode gap 28 provide the electrode coating space width $w_{ec}$ therebetween. The electrically conductive coating 40 along the electrode gap 28 preferably has a coating thickness $t_c$ of 5 to 30 microns. The electrically conductive coating 40 can extend along the entire length $l_e$ of the electrode body portion 56 between the firing tip 58 and the electrode terminal end 52, and typically along at least 80% of the length $l_e$.

Figure 6:
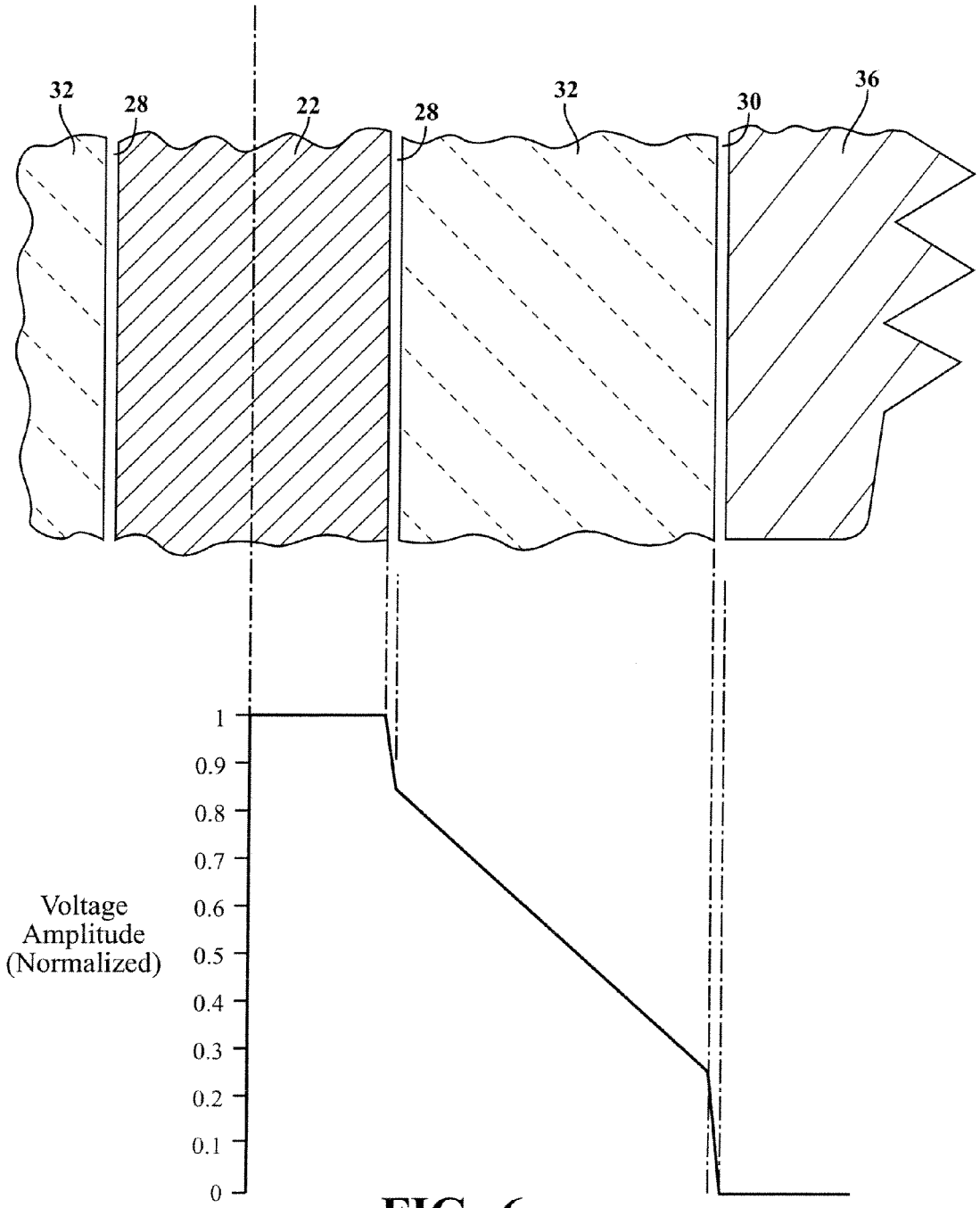
FIG. 6 Related Art
FIG. 6 is an enlarged view of a portion of a comparative corona igniter showing an uncoated electrode gap and an uncoated shell gap and graphs showing the normalized voltage across the comparative igniter.
Figure 7:
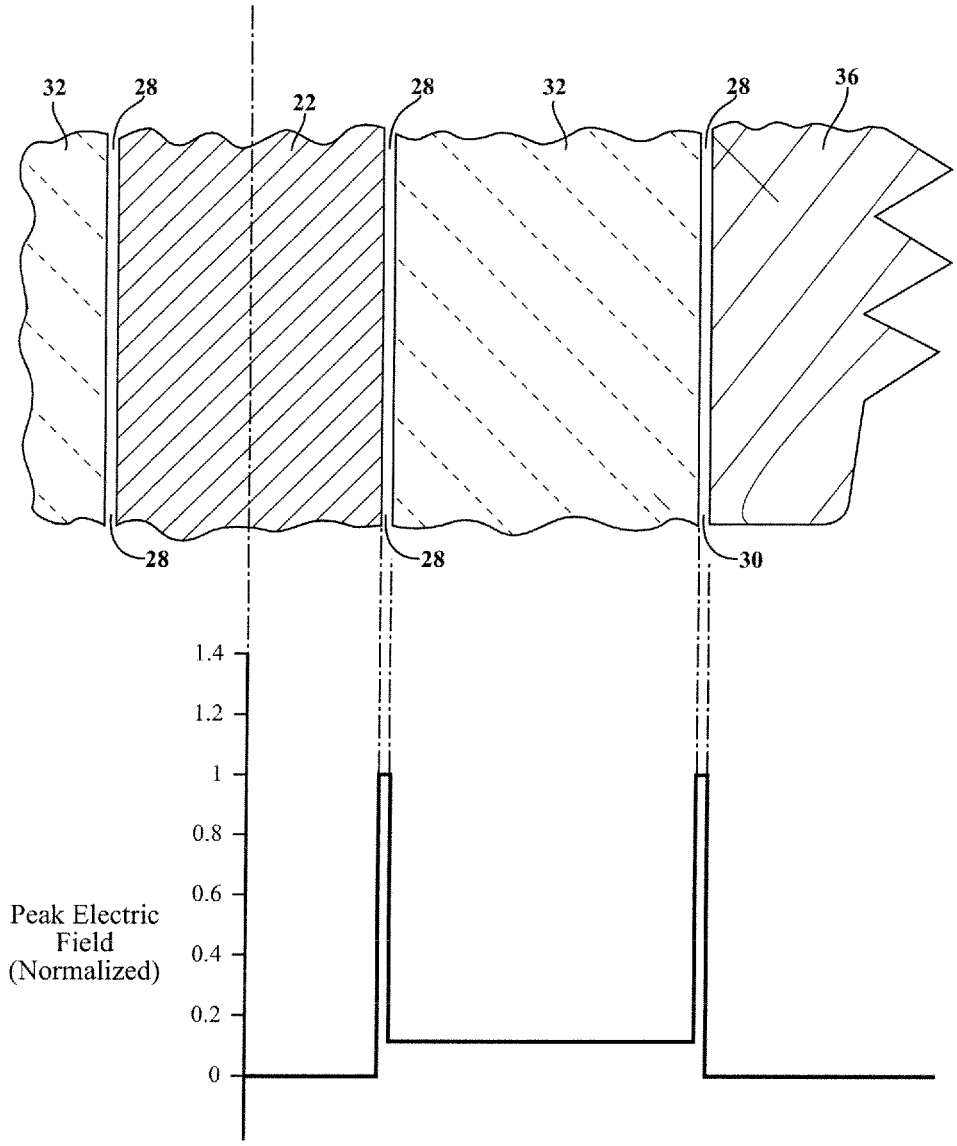
FIG. 7 Related Art
FIG. 7 is an enlarged view of a portion of a comparative corona igniter showing an uncoated electrode gap and an uncoated shell gap and graphs showing the normalized peak electric field across the comparative igniter.

Applying the electrically conductive coatings 40 to the insulator inner surface 64 along the electrode gap 28 provides significant advantages. In the comparative igniters of FIGS. 6 and 7, without the electrically conductive coating 40 along the electrode gap 28, there is a large difference between the permittivity of the insulator 32 and the permittivity of the air in the electrode gap 28. Thus, the voltage drops sharply at the electrode gap 28 and typically decreases by 10 to 20% of a total voltage drop from the central electrode 22 to the grounded metal shell 36. The electric field also increases sharply at the electrode gap 28. The electric field strength in the uncoated electrode gap 28 is typically 5 to 10 times higher than the electric field strength of the insulator 32.

Figure 5:
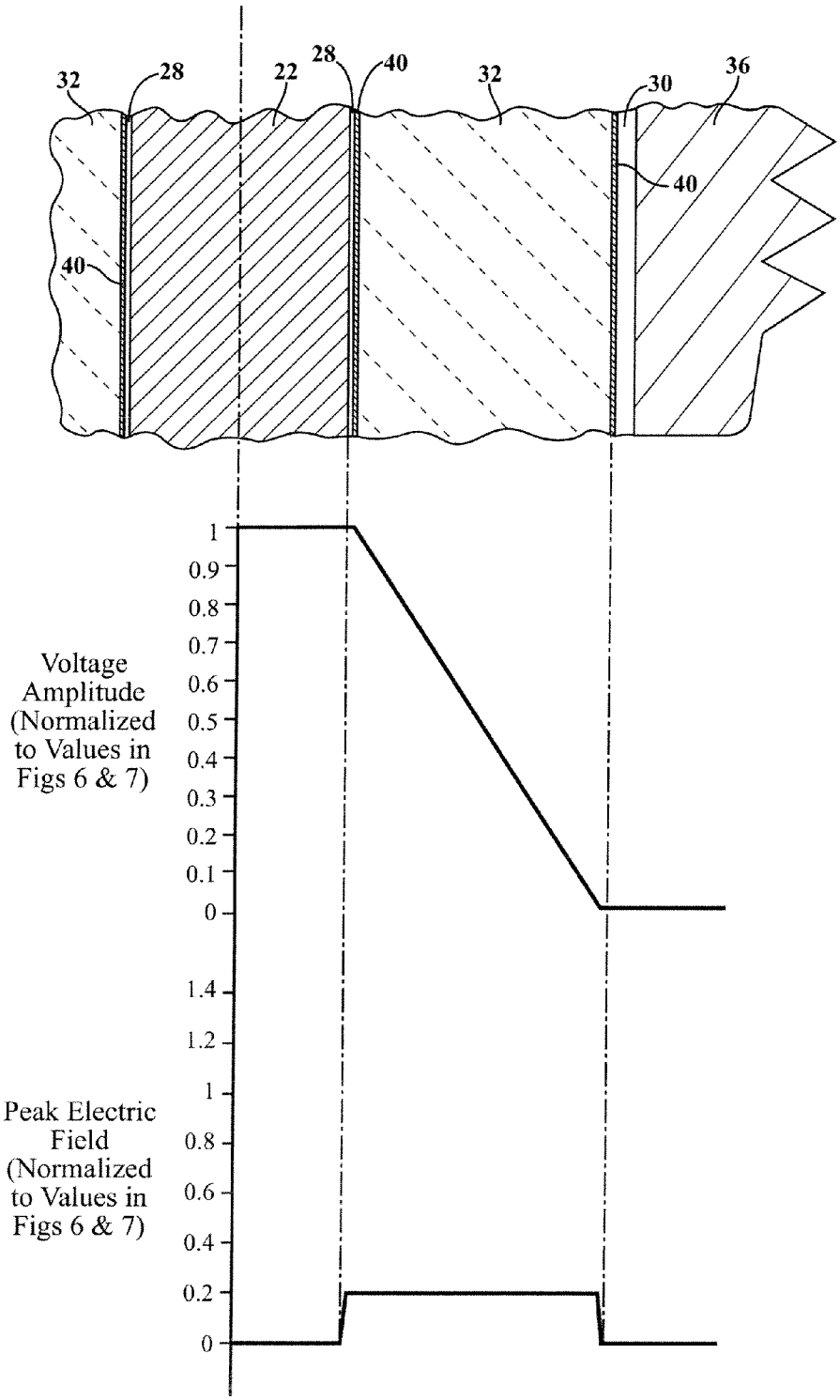
FIG. 5 is an enlarged view of a portion of a corona igniter according to another embodiment of the invention showing a coated electrode gap and a coated shell gap and graphs showing the normalized voltage and electric field across the igniter.

The electrically conductive coatings 40 of the present invention reduce the electric field in the electrode gap 28 and reduce the voltage variance across the electrode gap 28, as shown in FIG. 5. In one embodiment, the voltage decreases across the electrode gap 28 by not greater than 5% of the maximum voltage applied to the central electrode 22. The voltage drop across the coated electrode gap 28 is not greater than 5% of the total voltage drop from the central electrode 22 to the grounded metal shell 30. The electric field strength of the coated electrode gap 28 is typically not greater than one times higher than the electric field strength of the insulator 32, when a current of energy at a frequency of 0.5 to 5.0 megahertz flows through the central electrode 22. As shown in FIG. 5, the voltage and the peak electric field remain fairly constant across the coated electrode gap 28. For example, the electrode surface 23 adjacent the electrically conductive coatings 40 has a voltage and the insulator inner surface 32 adjacent the electrically conductive coatings 40 has a voltage, and the difference between the voltages is not greater than 5% of the maximum voltage applied to the central electrode 22, or not greater than 5% of the total voltage drop from the central electrode 22 to the grounded metal shell 30, when a current of energy at a frequency of 0.5 to 5.0 megahertz flows through the central electrode 22.

When the electrically conductive coating 40 is disposed along the shell gap 30, a second electrically conductive coating 40 is disposed on the insulator outer surface 72 between the insulator upper end 60 and the insulator nose end 62. As shown in FIG. 2B, the second electrically conductive coating 40 is radially spaced from the shell inner surface 94 across the shell gap 30 to provide a shell coating space width $w_{sc}$ therebetween. The electrically conductive coating 40 along the shell gap 30 preferably has a coating thickness $t_c$ of 5 to 30 microns. The electrically conductive coating 40 can extend along the entire length $l_s$ of the shell 36 between the shell upper end 44 and the shell lower end 92, and typically along at least 80% of the length $l_s$.

The corona igniter 20 of FIG. 1 includes different types of electrically conductive materials along different sections of the shell gap 30. One electrically conductive material extends longitudinally from adjacent the shell lower end 92 to the insulator lower shoulder 82. Another electrically conductive material extends longitudinally from the first electrically conductive material to adjacent the turnover lip 42. A third electrically conductive material then extends longitudinally from the second electrically conductive material to just above the shell upper end 44. The materials are selected based on characteristics of the corona igniter 20 in those regions.

The corona igniter 20 of FIG. 3 also includes different electrically conductive materials along different sections of the shell gap 30. One electrically conductive material extends longitudinally from the shell lower end 92 to just above the insulator nose shoulder 86. Another electrically conductive material extends from the first electrically conductive material to just below the turnover lip 42. Another electrically conductive material extends from the second electrically conductive material to just above the shell upper end 44.

Applying the electrically conductive coatings 40 to the insulator outer surface 72 along the shell gap 28 provides significant advantages. In the comparative igniter 20 of FIGS. 6 and 7, without the electrically conductive coating 40, there is a large difference between the permittivity of the insulator 32 and the permittivity of the air in the shell gap 28. Thus, the voltage drops sharply at the uncoated shell gap 28 and typically decreases by 10 to 20% of a total voltage drop from the central electrode 22 to the grounded metal shell 36. The electric field also increases sharply at the uncoated shell gap 28. The electric field strength in the uncoated shell gap 28 is typically 5 to 10 times higher than the electric field strength of the insulator 32.

Figure 4:
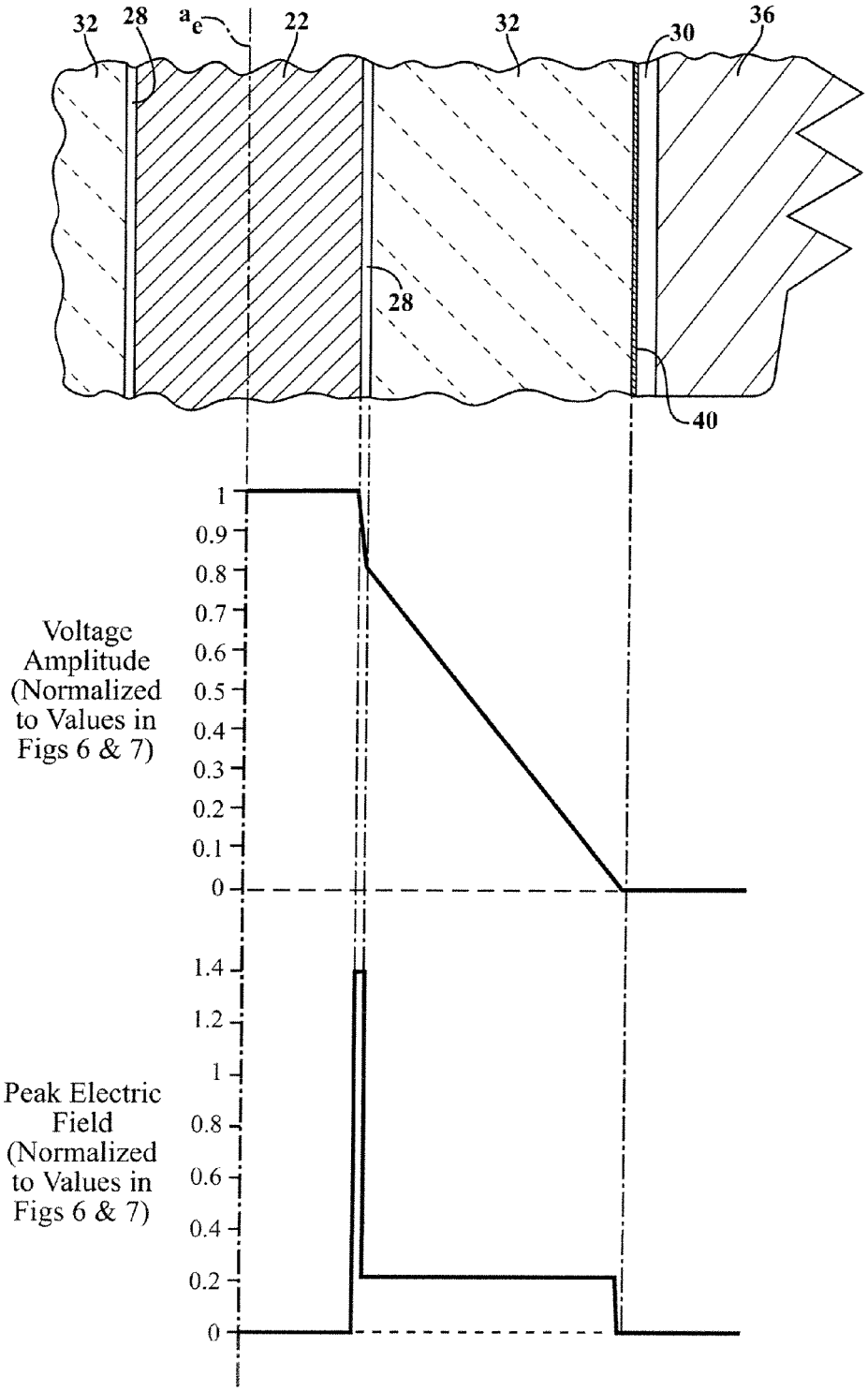
FIG. 4 is an enlarged view of a portion of a corona igniter according to one embodiment of the invention showing an uncoated electrode gap and a coated shell gap and graphs showing the normalized voltage and electric field across the igniter.

The electrically conductive coating 40 of the present invention reduces the electric field in the shell gap 28 and reduces the voltage variance across the shell gap 28, as shown in FIGS. 4 and 5. In one embodiment, the voltage decreases across the coated shell gap 28 by not greater than 5% of the maximum voltage applied to the central electrode 22. The voltage drop across the coated shell gap 28 is not greater than 5% of the total voltage drop from the central electrode 22 to the grounded metal shell 30. The electric field strength of the coated shell gap 28 is typically not greater than one times higher than the electric field strength of the insulator 32, when a current of energy at a frequency of 0.5 to 5.0 megahertz flows through the central electrode 22. As shown in FIGS. 4 and 5, the voltage and the peak electric field remain fairly constant across the coated shell gap 28. For example, the insulator outer surface 56 adjacent the electrically conductive coating 40 has a voltage and the shell inner surface 32 has a voltage, and the difference between the voltages is not greater than 5% of the maximum voltage applied to the central electrode 22, or not greater than 5% of the total voltage drop from the central electrode 22 to the grounded metal shell 30, when a current of energy at a frequency of 0.5 to 5.0 megahertz flows through the central electrode 22.

Although the corona igniter 20 only requires the electrically conductive coating 40 along one of the gaps 28, 30, as shown in FIG. 4, applying the electrically conductive coating 40 along both of the gaps 28, 30, as shown in FIG. 5, is especially beneficial. When the electrically conductive coating 40 is disposed along both gaps 28, 30, the corona igniter 20 has a voltage decreasing gradually and consistently from the central electrode 22 across the electrode gap 28, the insulator 32, and the shell gap 30 to the shell 36. In addition, the electric field remains fairly constant from the central electrode 22 across the electrode gap 28, the insulator 32, and the shell gap 30 to the shell 36. The electrically conductive coatings 40 can also be applied along any other air gaps found in the corona igniter 20.

The electrically conductive coatings 40 provides electrical continuity across the air gaps 28, 30. They prevent an electric charge from being contained in the gaps 28, 30, prevent electricity from flowing through the gaps 28, 30, and prevent the formation of ionized gas and corona discharge 24 in the gaps 28, 30, which could form a conductive path and arcing across the insulator 32 between the electrode 22 and the shell 36 or between the electrode 22 and the cylinder head 48. Thus, the corona igniter 20 is able to provide a more concentrated corona discharge 24 at the firing tip 58 and a more robust ignition, compared to other corona igniters.

Another aspect of the invention provides a method of forming the corona igniter 20. The method first includes providing the central electrode 22, the insulator 32, and the shell 36. Before assembling the components together, the method includes applying the electrically conductive coating 40 to the insulator surface 64, 72 along at least one of the gaps 28, 30, and preferably along both of the gaps 28, 30.

When the electrically conductive coating 40 is disposed along the electrode gap 28, the method includes applying a first electrically conductive coating 40 to the insulator inner surface 64, such that the diameter provided by the electrode surface 23 is less than the diameter provided by the second electrically conductive coating 40 on the insulator inner surface 64. After applying the electrically conductive coatings 40, the method includes inserting the central electrode (22) into the insulator bore such that the first electrically conductive coating 40 faces and is spaced radially from at least a portion of the electrically conductive coating 40 on the insulator inner surface 64 across the electrode gap 28. The first electrically conductive coating 40 may be disposed on the electrode head 34 and could contact the insulator inner surface 64 at that location.

When the electrically conductive coating 40 is disposed along the shell gap 30, the method includes applying a second electrically conductive coating 40 to the insulator outer surface 72, such that the diameter provided by the first electrically conductive coating 40 on the insulator outer surface 72 is less than the diameter provided by the shell inner surface 94. After applying the electrically conductive coating 40, the method includes inserting the insulator 32 into the shell bore such that the first electrically conductive coating 40 on the insulator outer surface 72 faces and is spaced radially from at least a portion of the shell inner surface 94 across the shell gap 30. The second electrically conductive coating 40 may be disposed adjacent the turnover lip 42 and could contact the shell inner surface 94 at that location.

In one embodiment, the method includes disposing the internal seal 38 on the shell seat 96 in the shell bore, and disposing the insulator 32 on the internal seal 38 to provide the shell gap 30. The method then includes forming the shell 36 about the insulator 32. In another embodiment, the method includes disposing the internal seal 38 on the insulator upper shoulder 78 and the forming step includes bending the shell upper end 44 radially inwardly around the internal seal 38 toward the insulator first region 74 to provide the turnover lip 42.

The electrically conductive coating 40 can be applied to the insulator surfaces 64, 72 according to a variety of different methods. In one embodiment, at least one of the steps of applying the electrically conductive coating 40 includes at least one of chemical vapor deposition, physical vapor deposition, and sputtering. In another embodiment, at least one of the steps of applying the electrically conductive coating 40 includes disposing an electrically conductive material on an intermediate carrier, and transferring the electrically conductive material from the intermediate carrier to the insulator surface 64, 72 to be coated. In yet another embodiment, at least one of the applying steps includes applying a mixture of an electrically conductive material and a glass powder and a liquid to the insulator surface 64, 72, followed by a heat treatment, which includes heating the mixture to evaporate the liquid and fuse the glass powder to the insulator surface 64, 72.

Obviously, many modifications and variations of the present invention are possible in light of the above teachings and may be practiced otherwise than as specifically described while within the scope of the appended claims.

ELEMENT LIST

| Element Symbol | Element Name |
|---|---|
| 20 | igniter |
| 22 | electrode |
| 23 | electrode surface |
| 24 | corona discharge |
| 26 | combustion chamber |
| 28 | electrode gap |
| 30 | shell gap |
| 32 | insulator |
| 34 | head |
| 36 | shell |
| 38 | internal seal |
| 40 | electrically conductive coating |
| 42 | turnover lip |
| 44 | shell upper end |
| 46 | cylinder block |
| 48 | cylinder head |
| 50 | piston |
| 52 | electrode terminal end |
| 54 | electrode firing end |
| 56 | electrode body portion |
| 58 | firing tip |
| 60 | insulator upper end |

-continued

| ELEMENT LIST | |
|---|---|
| Element Symbol | Element Name |
| 62 | insulator nose end |
| 64 | insulator inner surface |
| 66 | electrode seat |
| 68 | tip space |
| 70 | terminal |
| 72 | insulator outer surface |
| 74 | insulator first region |
| 76 | insulator middle region |
| 78 | insulator upper shoulder |
| 80 | insulator second region |
| 82 | insulator lower shoulder |
| 84 | insulator nose region |
| 86 | insulator nose shoulder |
| 88 | first terminal end |
| 90 | conductive seal layer |
| 92 | shell lower end |
| 94 | shell inner surface |
| 96 | shell seat |
| 98 | tool receiving member |
| 100 | shell outer surface |
| 102 | lip surface |
| $a_e$ | electrode center axis |
| $D_1$ | insulator first diameter |
| $D_2$ | insulator second diameter |
| $D_e$ | electrode diameter |
| $D_m$ | insulator middle diameter |
| $D_n$ | insulator nose diameter |
| $D_s$ | shell diameter |
| $D_t$ | tip diameter |
| $l_e$ | electrode body portion length |
| $l_s$ | shell length |
| $w_e$ | electrode gap width |
| $w_s$ | shell gap width |
| $w_{ec}$ | electrode coating space width |
| $w_{sc}$ | shell coating space width |
| $t_c$ | coating thickness |

What is claimed is:

1. A corona igniter for providing a corona discharge, comprising:

a central electrode formed of an electrically conductive material for receiving a high radio frequency voltage and emitting a radio frequency electric field to ionize a fuel-air mixture and provide a corona discharge, said central electrode extending from an electrode terminal end for receiving the high radio frequency voltage to an electrode firing end for emitting the radio frequency electric field, said central electrode extending along an electrode center axis and having an electrode surface facing away from said electrode center axis, an insulator formed of an electrically insulating material disposed around said central electrode and extending longitudinally from an insulator upper end past said electrode terminal end to an insulator nose end, said insulator including a plurality of regions between said insulator upper end and said insulator nose end, said insulator presenting an insulator inner surface facing said electrode surface and an oppositely facing insulator outer surface extending between said insulator ends, said insulator inner surface being spaced from at least a portion of said electrode surface to present an electrode gap therebetween, a shell formed of an electrically conductive metal material disposed around said insulator and extending longitudinally from a shell upper end to a shell lower end, said shell presenting a shell inner surface facing said insulator outer surface and extending between said shell ends, said shell inner surface being spaced from at least a portion of said insulator outer surface to present a shell gap therebetween, an electrically conductive coating disposed along at least one of said gaps on said insulator surface, said electrically conductive coating on said insulator surface being spaced radially from said facing surface across said gap, said electrically conductive coating including a plurality of materials, and wherein the material of said electrically conductive coating along one of said regions of said insulator is different from the material of said electrically conductive coating along another one of said regions of said insulator.

2. The igniter of claim 1 wherein said electrically conductive coating has a coating thickness of 5 to 30 microns.

3. The igniter of claim 1 wherein said electrically conductive coating on said insulator surface is spaced radially from said facing surface across said gap by a coating space width of 50 to 250 microns.

4. The igniter of claim 1 wherein said electrically conductive coating has an electrical conductivity of $9\times10^6$ S/m to $65\times10^6$ S/m.

5. The igniter of claim 1 wherein said electrically conductive coating includes a precious metal.

6. The igniter of claim 1 wherein said electrically conductive coating includes a mixture of a precious metal and a glass powder.

7. The igniter of claim 1 wherein said electrically conductive coating includes a non-precious metal.

8. The igniter of claim 1 wherein said electrically conductive coating includes a mixture of a non-precious metal and a glass powder.

9. The igniter of claim 1 wherein said electrically conductive coating includes silica in an amount of at least 30 wt. %, based on the total weight of said electrically conductive coating.

10. The igniter of claim 1 wherein said shell has a length from said shell lower end to said shell upper end and said electrically conductive coating extends along at least 50% of said length.

11. The igniter of claim 1 wherein said central electrode has a length and said conductive coating extends along at least 80% of said length.

12. A corona ignition system for providing a radio frequency electric field to ionize a portion of a fuel-air mixture and provide a corona discharge in a combustion chamber of an internal combustion engine, comprising:

a cylinder block and a cylinder head and a piston providing a combustion chamber therebetween, a mixture of fuel and air provided in said combustion chamber, an igniter disposed in said cylinder head and extending transversely into said combustion chamber for receiving a high radio frequency voltage and emitting a radio frequency electric field to ionize a portion of the fuel-air mixture and form said corona discharge, a central electrode formed of an electrically conductive material for receiving a high radio frequency voltage and emitting a radio frequency electric field to ionize a fuel-air mixture and provide said corona discharge, said central electrode extending from an electrode terminal end for receiving the high radio frequency voltage to an electrode firing end for emitting the radio frequency electric field, an insulator formed of an electrically insulating material disposed around said central electrode and extending longitudinally from an insulator upper end past said electrode terminal end to an insulator nose end, said insulator including a plurality of regions between said insulator upper end and said insulator nose end, said insulator presenting an insulator inner surface facing said central electrode and an oppositely facing insulator outer surface extending between said insulator ends, said insulator inner surface being spaced from at least a portion of said central electrode to present an electrode gap therebetween, a shell formed of an electrically conductive metal material disposed around said insulator and extending longitudinally from a shell upper end to a shell lower end, said shell presenting a shell inner surface facing said insulator outer surface and extending between said shell ends, said shell inner surface being spaced from at least a portion of said insulator outer surface to present a shell gap therebetween, a first electrically conductive coating disposed on said insulator inner surface, a second electrically conductive coating disposed on said insulator outer surface, said first electrically conductive coating on said insulator inner surface being spaced radially from said facing electrode surface across said electrode gap, said second electrically conductive coating on said insulator outer surface being spaced radially from said facing shell inner surface across said shell gap at least one of said electrically conductive coatings including a plurality of materials, and wherein the material of said at least one electrically conductive coating along one of said regions of said insulator is different from the material of said at least one electrically conductive coating along another one of said regions of said insulator.

13. A method of forming a corona igniter, comprising the steps of:

providing a central electrode formed of an electrically conductive material and presenting an electrode surface, providing an insulator formed of an electrically insulating material and including an insulator inner surface presenting an insulator bore extending longitudinally from an insulator upper end to an insulator nose end and including a plurality of regions between the insulator upper end and the insulator nose end, applying a conductive coating to the insulator inner surface, the step of applying the conductive coating including applying different material along different regions of the insulator, and inserting the central electrode into the insulator bore after applying the conductive coating such that the electrode surface faces and is spaced radially from at least a portion of the electrically conductive coating on the insulator inner surface across an electrode gap.

14. The method of claim 13, wherein the step of applying the conductive coating includes at least one of chemical vapor deposition, physical vapor deposition, and sputtering.

15. The method of claim 13, wherein the step of applying the conductive coating includes disposing an electrically conductive material on an intermediate carrier, and transferring the electrically conductive material from the intermediate carrier to the insulator inner surface.

16. The method of claim 13 wherein the step of applying the conductive coating includes applying a mixture of an electrically conductive material and a glass powder and a liquid to the insulator inner surface, and heating the mixture to evaporate the liquid to fuse the glass powder to the insulator inner surface.

17. A method of forming a corona igniter, comprising the steps of:

providing a central electrode formed of an electrically conductive material, providing an insulator formed of an electrically insulating material and presenting an insulator outer surface extending longitudinally from an insulator upper end to an insulator nose end and including a plurality of regions between the insulator upper end and the insulator nose end, applying a conductive coating to the insulator outer surface, the step of applying the conductive coating including applying different material along different regions of the insulator, providing a shell formed of an electrically conductive material and including a shell inner surface presenting a shell bore extending longitudinally from a shell upper end to a shell lower end, and inserting the insulator into the shell bore after applying the coatings such that the electrically conductive coating on the insulator outer surface faces and is spaced radially from at least a portion of the shell inner surface across a shell gap.

18. The method of claim 17, wherein the step of applying the conductive coating includes at least one of chemical vapor deposition, physical vapor deposition, and sputtering.

19. The method of claim 17, wherein the step of applying the conductive coating includes disposing an electrically conductive material on an intermediate carrier, and transferring the electrically conductive material from the intermediate carrier to the insulator outer surface.

20. The method of claim 17 wherein the step of applying the conductive coating includes applying a mixture of an electrically conductive material and a glass powder and a liquid to the insulator outer surface, and heating the mixture to evaporate the liquid to fuse the glass powder to the insulator outer surface.

* * * * *